US005577607A

United States Patent [19]

Drake et al.

[11] Patent Number: 5,577,607

[45] Date of Patent: Nov. 26, 1996

[54] CURLING IRON POUCH

[76] Inventors: Anthony G. Drake; David J. Bluestein, both of 8541 Thys Ct., Sacramento, Calif. 95828

[21] Appl. No.: 401,556

[22] Filed: Mar. 9, 1995

[51] Int. Cl.[6] ..... A45C 11/00; B65D 81/38

[52] U.S. Cl. ..... 206/349; 150/161; 206/581; 219/242; 383/40

[58] Field of Search ..... 206/349, 373, 206/581, 525; 150/161; 383/40, 95; 219/222, 227, 242; D3/205; D28/35, 38

[56] References Cited

U.S. PATENT DOCUMENTS

| | | | |
|---|---|---|---|
| D. 201,486 | 6/1965 | Stolarz | D3/205 |
| D. 261,317 | 10/1981 | Oberheim . | |
| D. 348,542 | 7/1994 | Cannella . | |
| D. 350,230 | 9/1994 | O'Brien | D3/205 |
| 479,655 | 7/1892 | Morton | 383/95 X |
| 972,494 | 10/1910 | Barnett | 383/95 X |
| 1,220,793 | 3/1917 | Spector | 383/40 X |
| 1,479,136 | 1/1924 | Guinzberg | 383/95 |
| 1,506,926 | 9/1924 | Gunter | 383/40 |
| 4,570,792 | 2/1986 | Conway . | |
| 4,660,610 | 4/1987 | McIntire, III | 206/349 X |
| 4,973,019 | 11/1990 | Baird . | |
| 5,141,189 | 8/1992 | Andrew . | |

FOREIGN PATENT DOCUMENTS

| | | | |
|---|---|---|---|
| 849686 | 9/1960 | United Kingdom | 383/40 |

*Primary Examiner*—Bryon P. Gehman
*Attorney, Agent, or Firm*—Joseph E. Gerber

[57] ABSTRACT

A curling iron pouch comprised of an inner heat-resistant pocket and a pair of outer, auxiliary pockets is disclosed. The inner pocket is comprised of a pair of longer, generally rectangular panels, and the outer pockets are comprised of a pair of shorter, generally rectangular panels. The four panels are affixed to one another by a common seam around an end edge and along a substantial portion of their side edges. A pair of open end edges of the inner pocket project beyond the open tops of the outer pockets. The opposing inner panel surfaces adjacent the open end edges of the inner pocket include opposed mating portions of a snap. The longer panels of the inner pocket are of a three-layer construction and are comprised of a pair of outer heat-resistant textile fabric sheets with a layer of nonflammable, nonwoven, insulative batting material therebetween. A kit including the inventive pouch; a curling iron having a hair clip lever projecting acutely from its handle; and, a hair grooming instrument, is also disclosed.

12 Claims, 4 Drawing Sheets

CURLING IRON POUCH

BACKGROUND OF THE INVENTION

1. Field of the Invention

The present invention relates generally to textile fabric pouches for personal articles, and more specifically relates to thermally-insulated pouches for immediate storage and transport of hot hair-curling appliances.

2. Description of the Related Art

Curling irons bring great convenience to the chore of grooming. The advantages over the use of common wet-set curlers, in both time-savings and versatility, are well known. However, despite their advantages, curling irons have the drawback of remaining dangerously hot for some time after use. Most curling irons include a retractable bail, or the like, upon which the iron may be propped to cool. Nevertheless, a cooling curling iron remains vulnerable to being upset by accident, as for example by the act of a child, as a result of which damage or injury could occur. And, a hot curling iron presents a particular problem for travelers, because packing is often conducted in a hurried fashion, and a just-used iron cannot be safely stowed with other items.

Most curling irons currently marketed for personal use are elongate in configuration and include a handle portion, a heating element projecting therefrom, and a spring-biased, lever-operated clip for holding a curl of hair against the heating element. A first type of curling iron is electrically operated and includes a power cord which projects from its handle. A second type employs combustible gas, commonly butane, as the source of heating energy. The fuel reservoir of a gas-burning curling iron is usually in its handle. Thus, handles of gas-burning curling irons are often somewhat larger than those of electric models; although, the sizes of electric curling iron handles vary quite widely as well.

The hair clip mechanism of most curling irons is mounted at a fixed fulcrum close to the junction between the iron's handle portion and its heating element. The curl-retaining portion of the clip mechanism projects forward from the fulcrum and nests against the heating element. The lever portion of the clip projects outward from the fulcrum, and rearward, flanking the handle. When the clip lever is depressed toward the handle, the clip's forward, curl-retaining portion is driven away from the heating element a distance sufficient for a lock of hair to be wrapped around the heating element for heating, or to be unwrapped for release afterward.

The problems and dangers of hot curling irons are as well known as their advantages, and have been addressed in the art. For example, for an iron used at a fixed location, various wall-mounted holsters, and the like, have been proposed for providing secure support for the iron as it cools. One such holster is shown in U.S. Pat. No. 5,141,189 issued to Andrew in 1992. Therein, Andrew discloses a substantially rigid structure which engages a curling iron and partially encloses its heating element. If securely mounted to a surface, Andrew's device would reduce the risk of such accidents as are most likely to occur in a home or, for example, in a salon work space. However, a tug on the electrical cord of a hot iron supported by the Andrew device could plainly disengage the iron therefrom. And, even while engaged, Andrew's partial sleeve leaves a significant portion of the heating element exposed, thus rendering Andrew's device unacceptable for use as a travel case.

Various other holsters are shown in U.S. Pat. No. 4,937,019 issued to Baird, et al. in 1990. As with the disclosure of Andrew, the devices of Baird, et al. are designed for surface mounting, and therefore may be adequate for use at a fixed grooming location. However, all the devices disclosed in Baird, et al. leave a curling iron's heating element more or less exposed, or loosely engaged.

A rigid cover for a curling iron's entire heating element is shown in U.S. Pat. No. Des. 261,317 issued to Oberheim, et al. in 1981. Use of the cover disclosed in Oberheim, et al. might prevent injury or damage from the heating element of a curling iron accidentally upset while cooling. However, the Oberheim, et al. reference does not disclose any insulating or heat-venting structure, so it appears a curling iron would require pre-cooling before being covered as depicted therein. Thus, while most dangerously hot, the heating element would necessarily remain exposed. Yet further, the Oberheim, et al. cover has the additional drawback that a differently-constructed cover would be required to accommodate the unique shape of each different model of curling iron offered by each different manufacturer.

Soft-sided travel pouches for curling irons are shown in U.S. Pat. No. 4,570,792 issued to Conway in 1986, and in U.S. Pat. No. Des. 348,542 issued to Cannella in 1994. Both are similarly constructed: two generally rectangular panels, one shorter, one longer, but similar in width, are registered with one another and joined around three of their common outer edges to define a pocket therewithin. The longer panel serves as a closure flap over the pocket's opening. The pouch disclosed in Conway is insulated and includes a pair of opposed ribbons for retaining an electrical curling iron's cord. Cannella's closure flap includes an additional panel defining an auxiliary pocket for the cord. However, despite superior portability and other advantages over devices as in Andrew, Baird, et al. and Oberheim, et al., the constructions of Conway and Cannella would restrict cooling circulation, and their cord retention means appear somewhat cumbersome to employ. And, although Cannella's interior pocket may be adequate to receive a curling iron's cord, its shape and size make it unlikely to be useful for carrying any other personal hair-grooming accoutrements such as brushes or combs.

Further, the Conway and Cannella pouches have closed ends with closure flaps; pouches so constructed would likely be somewhat limited in the size of curling iron they could accommodate. For example, the large handle of a gas-burning curling iron would likely require a flap-ended pouch somewhat longer than that for an electric curling iron. So, construction of either a different-sized pouch for each, or one wastefully large pouch, would be necessary. In addition, if used for housing a gas curling iron, the cord retention means provided in Conway and Cannella, i.e. the ribbons and pocket, respectively, would be superfluous. And, neither would those means be very well suited for retaining or stowing most commonly used grooming accessories.

Thus, it appears that a need exists for apparatus able to receive a hot curling iron safely and securely, which is, at once, able to permit the iron to cool efficiently. And, it should serve those purposes equally well, whether used at a fixed grooming location, or packed for traveling. It would also be desirable if such apparatus, in a single size, could accommodate all common sizes and constructions of gas and electric curling irons. Yet further, means for retaining an electric curling iron's cord, and/or for stowing other common hair grooming accessories, would be additionally beneficial.

SUMMARY OF THE INVENTION

The curling iron pouch of the present invention is adapted to overcome the above-noted shortcomings and to fulfill the stated needs. It includes a heat-resistant fabric pocket having a closed end and an open end; a pair of mating fastening members disposed in opposed relation to one another on opposed inner surfaces of the pocket, these fastening members being particularly adapted to fasten discrete points on those opposed surfaces together; and, an auxiliary pocket affixed to an outer surface of the heat-resistant pocket.

The invention claimed herein also includes a kit, comprising: a curling iron; a heat-resistant pouch of the above-described construction; and, a hair grooming instrument in the auxiliary pocket.

It is an object of the present invention to provide a heat-insulated curling iron pouch which, in one size and configuration, is able to accommodate the large majority of commonly-available electrically-heated and gas-burning personal curling irons.

It is a further object of the present invention to provide a heat-insulated curling iron pouch which is useful and effective for protecting persons and property from a hot curling iron at a fixed grooming location, and which is equally useful and effective for safely packing a hot curling iron with other personal items for traveling.

Yet another object of the present invention is to provide a curling iron pouch which is extremely easy to use in covering a hot curling iron but which, by interaction with a unique structural feature common to most curling irons, provides a very secure engagement making it exceedingly unlikely that the inventive pouch will become disengaged therefrom.

Yet a further object of the present invention is to provide a curling iron pouch which, even while a hot cooling iron is securely engaged therewithin, permits circulation of cooling air to the curling iron.

Another object of the present invention is to provide a curling iron pouch which includes a primary heat-insulated pouch as well as easy to use outer, auxiliary pockets for safely stowing an attached electrical cord and/or personal grooming items wherein, while those pockets are so used, enhanced circulation of cooling air to the pouch's primary pocket is promoted.

And it is also an object of the present invention to provide a curling iron pouch which is exceedingly simple in structure and therefore very inexpensive to manufacture.

Still further objects of the inventive curling iron pouch disclosed herein will be apparent from the drawings and following detailed description thereof.

DESCRIPTION OF THE PREFERRED EMBODIMENT

Figure 1:
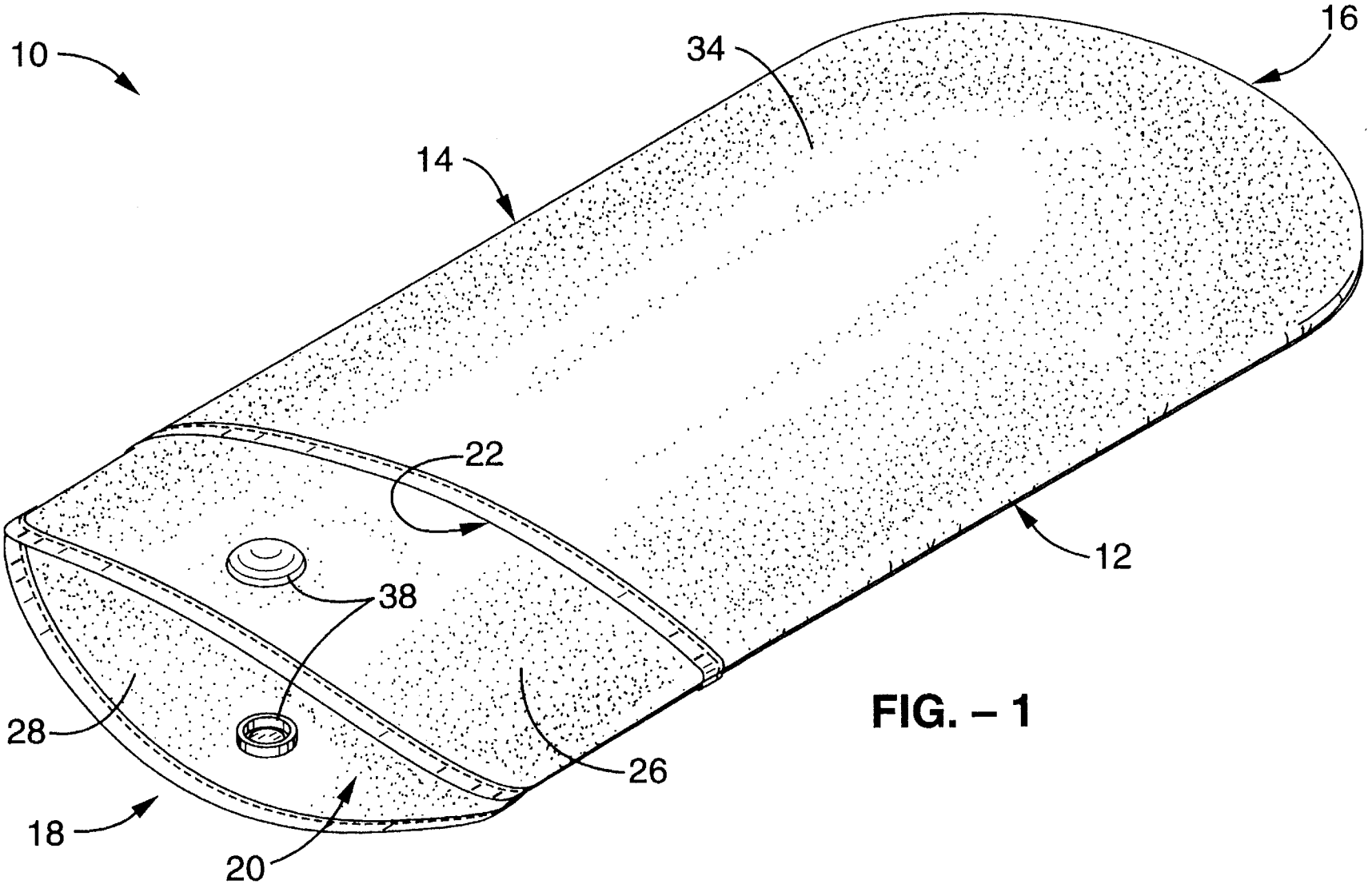
FIG. 1 is a perspective view of the curling iron pouch of the invention.
Figure 2:
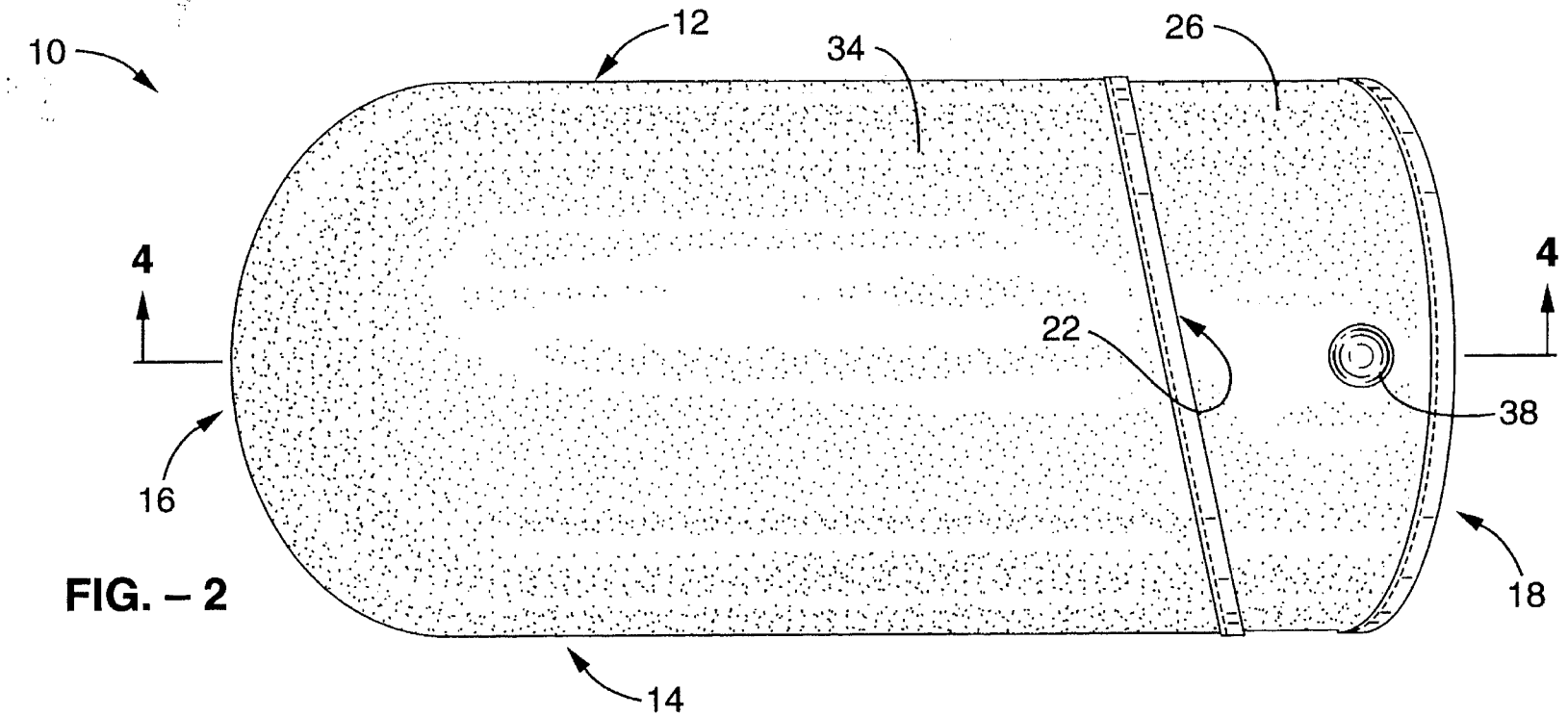
FIG. 2 is a top plan view of the curling iron pouch shown in FIG. 1.
Figure 3:
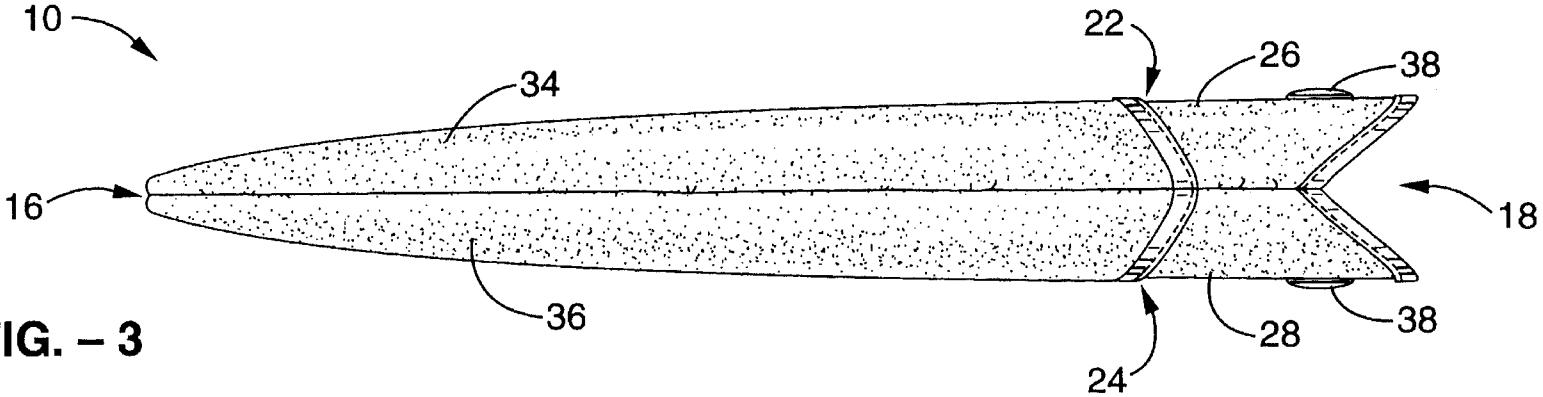
FIG. 3 is a side elevation of the curling iron pouch shown in FIG. 1.

Referring now specifically to the drawings, FIGS. 1 through 3 show the inventive curling iron pouch, which is generally identified herein with the reference numeral 10. Pouch 10 is generally rectangular in shape, having a pair of parallel, elongate side edges 12 and 14; a rounded, closed end edge 16; and, a rounded, open end 18. An insulated primary pocket 20 lies at pouch 10's interior, and first and second slash-topped, auxiliary side pockets 22 and 24 flank, and partially cover, pocket 20's outer surfaces.

Pouch 10 is comprised of four panels, two longer and two shorter. The longer are first and second primary panels 26 and 28, respectively. Primary panels 26 and 28 are generally rectangular, having parallel, elongate side edges, but somewhat rounded ends. They are identical in size and shape to one another; the perimeter of each registers with that of the other when the panels are stacked.

Figure 4:
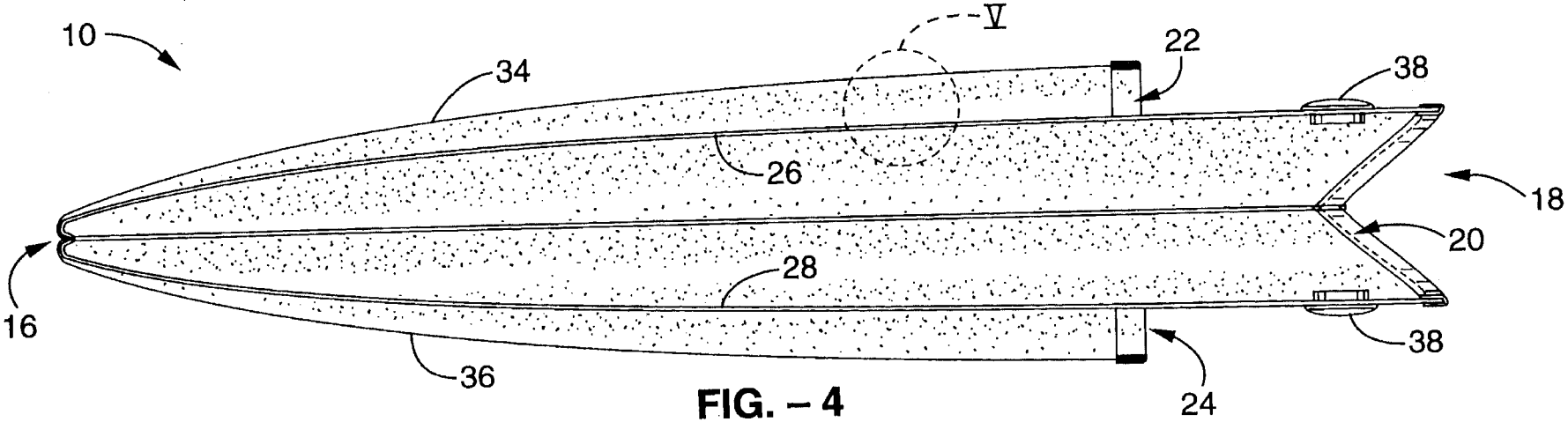
FIG. 4 is a cross-sectional view of the curling iron pouch of FIG. 2, shown in a more open configuration, and taken on line 4—4 thereof.
Figure 5:
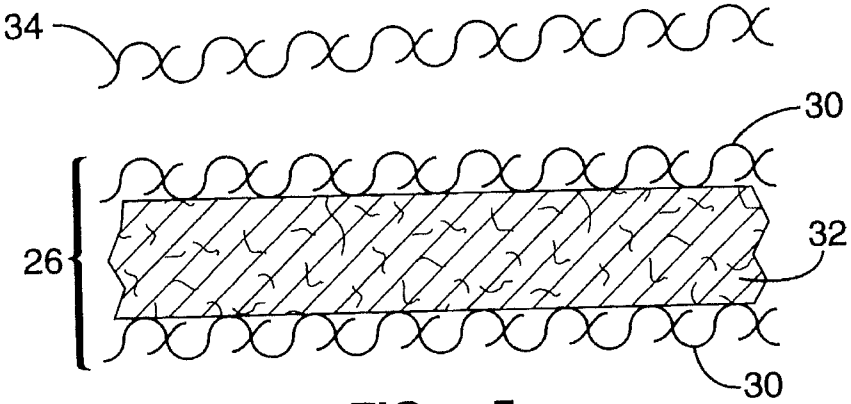
FIG. 5 is an enlarged detail of the cross-sectional view of FIG. 4 taken from within the dashed-line circle of FIG. 4 labeled as "V."

Panels 26 and 28 each preferably have a multi-layered construction, the three-layered construction described hereinbelow having been found to be sufficient. As shown in FIGS. 4 and 5, the outer two layers of each panel, 26 and 28, are comprised of sheets of heat-resistant nylon textile fabric 30, and the interior layer of each is comprised of a non-flammable, nonwoven, insulative batting material 32. Other constructions or compositions of panels 26 and 28 might work as well but, panels 26 and 28 should, at least, have outer surfaces resistant to marring by a hot curling iron, and some means therebetween for inhibiting the transmission of heat.

The shorter panels of pouch 10, first and second panels 34 and 36, respectively, are also generally rectangular in shape, each having parallel, elongate side edges spaced apart to the same width as the side edges of primary panels 26 and 28. Each short panel 34 and 36 also has a pair of opposing end edges, one of which is rounded and matches the curve of the end edges of panels 26 and 28, the other of which is straight, but somewhat nonperpendicular to the side edges. Thus, when stacked with primary panels 26 and 28, the side edges and rounded end edges of shorter panels 34 and 36 register with those of panels 26 and 28; and these, in turn, define pouch 10's side edges 12 and 14, and closed end edge 16. However, as panels 34 and 36 are shorter than panels 26 and 28, the straight, nonperpendicular end edges of panels 34 and 36 fall short of the rounded, open end edges of panels 26 and 28.

Shorter panels 34 and 36 are comprised of a single sheet of heat-resistant textile fabric, nylon of the same variety as that used on the outer surfaces of primary panels 26 and 28 having been found to suit this purpose well. However, other fabric constructions may perform just as satisfactorily.

Panels 26 and 28, and panels 34 and 36, are securely affixed to one another around that portion of their respective perimeters which is identical to that of all the others. Thus, a continuous seam runs down the entire length of both side edges of all four panels, and around the closed end edge of each, securing all together and thereby defining pockets 20, 22 and 24.

In the preferred embodiment of the invention, the residual projecting edge of above-described continuous seam resides within primary pocket 20. This yields the most finished appearance. Thus, in construction, it is preferred that the four panels be first stacked so that shorter panels 34 and 36 lie flush against one another, and so each longer, primary panel 26 and 28 lies against an outer face of one of the shorter panels. Once the seam is in place, pouch 10 is turned inside-out, thus giving it the blind-seamed, finished appearance shown in the drawings.

Alternatively, and perhaps preferably, to achieve better alignment of the panels in construction of pouch 10, two halves, each being constructed of a short and a long panel, may be first sewed together. Then, these two halves may be, in turn, sewed to one another with a single surrounding seam before the pouch is turned inside-out for use.

Pocket 10 also includes means near its open end 18 for fastening two discrete points together on the opposing inner faces of primary panels 26 and 28. And, for purposes that will become evident below, the points to be fastened to one another should be midway between the side edges of each panel. As shown in the drawing figures, these fastening means are preferably comprised of a pair of mating male and female metal snap members 38, one not being differentiated from the other herein. Snaps 38 are the fastening means of choice, but other mating members such as small patches of hook and loop fabric, mating button holes and buttons, or other types of fasteners may also suffice. However, for positive closure and ease of operation, snaps 38 of the type disclosed are preferred.

Pouch 10 is preferably constructed and marketed in a single size, this size being carefully calculated to accommodate the great majority of commercially-available personal curling irons, without sacrificing economy or safety. Although the overall sizes and shapes of curling irons vary greatly, the lengths of their heating elements are all surprisingly similar. Inventive pouch 10 herein takes unique advantage of that fact in that it primarily covers a curling iron's heating element. In contrast, the curling iron's handle 42, which poses no danger of heat-caused damage or injury, simply projects uncovered from pouch 10's open end 18.

The preferred dimensions of pouch 10 include a length of approximately 10.5 inches, and a width of approximately 4.75 inches. The distance between snap 38 and closed end 16 is important because, in order to accommodate the majority of curling irons 40, this distance must be just a bit longer than the longest distance between the tip of any common, commercially-available iron's heating element (not shown), and the interior apex, or crotch, between the iron's handle 42 and its angularly-projecting hair clip lever 44. Thus, the preferred distance between snap 38 and pouch 10's closed end 16 is approximately 10 inches.

Although the heating element portions of most common curling irons are similar in length, irons are now being marketed with elements having a wide range of circumferences. The preferred width of pouch 10 takes that variability into account, and has been found sufficient to accommodate curling iron heating elements in the full range of circumferences currently available in the market.

Once a hot curling iron 40 is inserted into pouch 10, it is able to be locked securely in place by engagement of the two mating fastening members 38, because those fastening members mate in the crotch between the curling iron's handle 42 and its clip lever 44. The placement of snap 38 is important. It should be approximately equidistant between pouch 10's side edges 12 and 14, and adjacent end edge 18 about ten inches from closed end 16, because the large majority of commercially-available curling irons have similarly-configured crotches approximately 10 inches, or less, from the distal ends of their heating elements. Such placement of snap 38 makes pouch 10, in a single size, able to accommodate, safely and securely, nearly any curling iron on the market.

In order to maximize pouch 10's ability to receive curling irons of varying sizes, snap 38, or alternative fastening means or members, should be as small as possible. That is, only discrete points on the opposing inner surfaces of panels 26 and 28 should be bound to one another. That is, the smaller the surface area occupied by such point-fastening means or members, the better, as long as secure engagement is not compromised. This permits a pouch so constructed to accommodate the greatest range of sizes, shapes and placements of the crotches of differently-configured curling irons.

Once the opposing members of snap 38 are fastened in a curling iron's crotch, that curling iron is very effectively prevented from being withdrawn from pouch 10. Even a sharp jerk on power cord 46 sufficient to pull a cooling curling iron from a supporting surface will not disengage the iron from pouch 10. Yet, even when locked in place in this manner, substantial venting and air circulation to the interior of pouch 10 occurs because pouch 10's open end 18 is fastened closed only at a single point. See FIG. 6.

Figure 6:
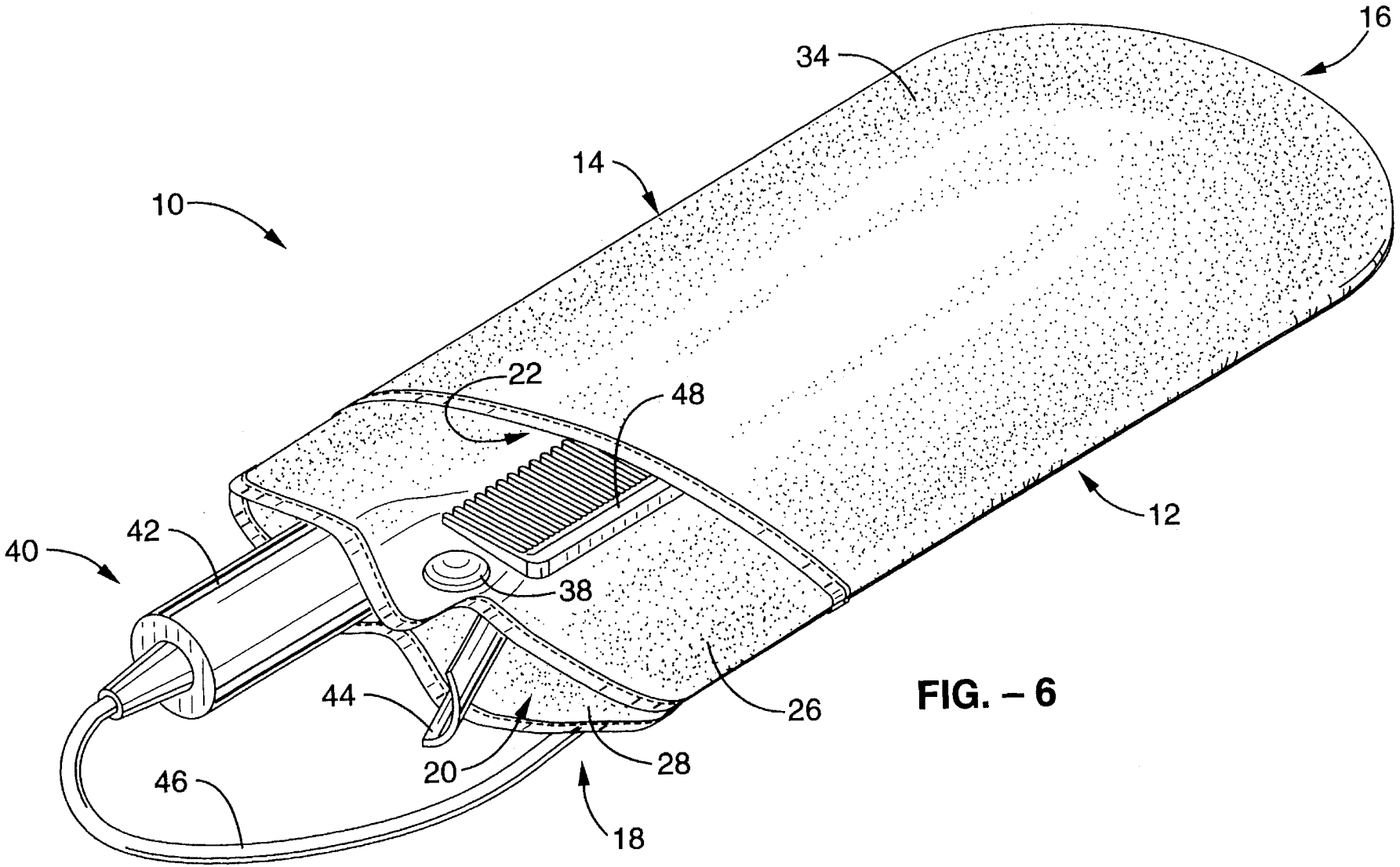
FIG. 6 is a perspective view of the kit of the invention, showing the curling iron pouch of FIG. 1 along with a curling iron secured therewithin, and a personal grooming instrument in a pocket thereof.

When curling iron 40 and pouch 10 are so engaged, air circulation to the outer surfaces of primary, heat-resistant pocket 20's primary panels 26 and 28 is even further enhanced if one or both of pouch 10's auxiliary side pockets, 22 and/or 24, is distended to accommodate either curling iron 40's own cord 46, as suggested in FIG. 6, or one or more personal grooming instruments such as comb 48.

Side pockets 22 and 24 yield yet further utility in that they provide an additional, albeit thinner, layer of insulating material over a curling iron's heating element.

Of course, in the case of gas-burning curling irons which have no power cord, side pockets 22 and 24 both remain available for grooming instruments and/or for a butane gas refill cartridge, for example.

Pouch 10's four-paneled construction yields superior insulating qualities, while being comprised of low-cost materials and while being exceedingly simple and inexpensive to assemble during manufacture. Economy and efficiency are maximized in the unique construction, which yields three pockets from four panels and a single seam. Further, the slant-topped configuration of the two side pockets 22 and 24, combined with the set-back relationship of their open tops with respect to pouch 10's open end 18, makes them very easy to operate. For example, a user is able to hold pouch 10 in one hand and, by squeezing its side edges 12 and 14 toward one another, side pockets 22 and 24, as well as primary pocket 20, are forced open and made ready for insertion of items to be contained therewithin.

Once a hot curling iron 40 is inserted in pouch 10 and the mating members of snap 38 are engaged to bind the hot iron in place, the iron-containing pouch may simply be laid upon a table, for example, to cool. Or, the iron-containing pouch may be slipped into a purse, or it may be packed into an item of luggage, for safe and secure transport.

As shown in FIG. 6, the kit of the invention includes curling iron 40, pouch 10 and a hair grooming instrument such as comb 48 in a side pocket of pouch 10. Together, these cooperate to provide great convenience as a transportable hair grooming kit. Alternatively, although FIG. 6 shows an electric curling iron, the inventive kit may include, for example, a butane cartridge (not shown) in one of pouch 10's pockets instead of an electric cord.

The foregoing detailed disclosure of the inventive curling iron pouch 10 is considered as only illustrative of the preferred embodiment of, and not a limitation upon the scope of, the invention. Those skilled in the art will envision many other possible variations of the structure disclosed herein that nevertheless fall within the scope of the following claims. For example, other primary pocket constructions such as might be fashioned from a single piece of fabric folded and sewed into the shape of a tube, and closed at one end, would suffice. Likewise, a single, elongate piece of fabric, folded at half its length to form a closed end, and sewed along its edges, would be functionally similar to the primary pocket herein.

And, alternative uses for this inventive pouch may later be realized. Accordingly, the scope of the invention should be determined with reference to the appended claims, and not by the examples which have herein been given.

I claim:

1. A curling iron pouch, comprising:

a. a heat-resistant pocket, said pocket having a closed end and an open end;

b. a pair of opposed, mating, point-fastening members disposed on opposed inner surfaces of said pocket, adjacent said open end of said pocket; and, c. an auxiliary pocket affixed to an outer surface of said heat-resistant pocket.

2. The pouch of claim 1, wherein said pouch is elongate and has opposed, parallel side edges, and wherein said auxiliary pocket has an open end edge which is non-perpendicular to said parallel side edges of said pouch.

3. The pouch of claim 1, wherein said fastening members comprise mating male and female portions of a snap.

4. The pouch of claim 3, wherein said snap is disposed approximately equidistant between side edges of said heat-resistant pocket.

5. The pouch of claim 1, wherein said heat-resistant pocket is comprised of multi-layered fabric wherein outer layers of said multi-layered fabric are resistant to marring by a hot curling iron, and wherein an insulative interior layer is disposed between said outer layers of said multi-layered fabric.

6. The pouch of claim 5, wherein said insulative layer is nonwoven batting.

7. A curling iron pouch, comprising:

a. a heat-resistant fabric pocket, said pocket having a closed end and an open end;

b. opposed mating fastening members disposed adjacent said open end of said pocket, said fastening members being positioned to fasten between divergent portions of a curling iron when the curling iron is within said heat-resistant pocket; and, c. an auxiliary pocket affixed to an outer surface of said heat-resistant pocket.

8. A curling iron pouch, comprising:

a. a first elongate primary panel and a second elongate primary panel, said panels being comprised of heat-resistant fabric, said panels being of similar size and shape and joined to one another around a substantial portion of a common edge, whereby a primary pocket is defined, said primary pocket being adapted for receipt of a curling iron, wherein the curling iron has divergent portions;

b. a fabric panel shorter than said primary panels and joined to an outer surface of said primary pocket, whereby an auxiliary pocket is defined; and, c. means for fastening a point on an inner surface of said first primary panel to an opposing point on an inner surface of said second primary panel, wherein said opposing points on said primary panels reside adjacent an opening in said primary pocket, and wherein, when a curling iron is received within said primary pocket, said fastening means operates to fasten said points together between the divergent portions of the curling iron, thereby securing the curling iron within said primary pocket.

9. A hair curling kit, comprising:

a. a curling iron;

b. a heat-resistant pouch, comprising:

i. a heat-resistant fabric pocket, said pocket having a closed end and an open end;

ii. opposed mating fastening members disposed adjacent said open end of said pocket, said fastening members being positioned to fasten between divergent portions of said curling iron when said curling iron is within said heat-resistant pocket, thereby securing said curling iron therewithin; and, iii. an auxiliary pocket affixed to an outer surface of said heat-resistant pocket;

c. a hair grooming instrument in said auxiliary pocket.

10. A hair curling kit, comprising:

a. a curling iron, comprising:

i. a handle;

ii. a heating element projecting from and coaxial with said handle;

iii. a hair clip lateral to said heating element and biased thereagainst by a spring; and, iv. a clip lever integral with said hair clip and projecting from said handle at an acute angle, said clip lever being operable to move said hair clip away from said heating element;

b. a heat-resistant pouch, comprising:

i. first and second elongate primary panels comprised of heat-resistant fabric, said panels being of similar size and shape and joined to one-another around a substantial portion of a common edge, whereby a primary pocket is defined, said primary pocket being adapted for receipt of said curling iron;

ii. a fabric panel shorter than said primary panels and joined to an outer surface of said primary pocket, whereby an auxiliary pocket is defined; and, iii. means for fastening a point on an inner surface of said first primary panel to an opposing point on an inner surface of said second primary panel, wherein said opposing points on said primary panels reside adjacent an opening in said primary pocket, and wherein, when said curling iron is received within said primary pocket, said fastening means operates to fasten said points together between said curling iron's handle and clip lever, thereby securing said curling iron within said primary pocket;

c. a hair grooming instrument in said auxiliary pocket.

11. The kit of claim 10, wherein said curling iron includes a power cord extending therefrom, and wherein said auxiliary pocket is dimensioned to receive and retain said power cord.

12. The kit of claim 10, wherein said auxiliary pocket is dimensioned to provide an additional layer of fabric over substantially the entire length of a heating element of said curling iron when said curling iron is secured within said pouch.

* * * * *